US008376057B2

(12) United States Patent
Dyson et al.

(10) Patent No.: US 8,376,057 B2
(45) Date of Patent: Feb. 19, 2013

(54) TUBING HANGER SEAL

(75) Inventors: Andy Dyson, Scotland (GB); Charles Li, Spring, TX (US); Oystein Mogedal, Oslo (NO); Paulo Cezar Silva Paulo, Katy, TX (US); Nick Newlands, Oslo (NO)

(73) Assignee: Aker Subsea Inc., Houston, TX (US)

( * ) Notice: Subject to any disclaimer, the term of this patent is extended or adjusted under 35 U.S.C. 154(b) by 316 days.

(21) Appl. No.: 12/543,912

(22) Filed: Aug. 19, 2009

(65) Prior Publication Data

US 2010/0084143 A1 Apr. 8, 2010

Related U.S. Application Data

(60) Provisional application No. 61/090,462, filed on Aug. 20, 2008, provisional application No. 61/090,000, filed on Aug. 19, 2008.

(51) Int. Cl.
*E21B 23/00* (2006.01)

(52) U.S. Cl. ..... 166/382; 166/348; 166/208; 166/75.14; 277/339; 277/340

(58) Field of Classification Search ..... 166/382, 166/348, 75.14, 208; 277/322, 339, 340, 277/566, 567; 175/57
See application file for complete search history.

(56) References Cited

U.S. PATENT DOCUMENTS

| | | | | |
|---|---|---|---|---|
| 4,742,874 | A | 5/1988 | Guillion | |
| 5,044,672 | A * | 9/1991 | Skeels et al. | 285/98 |
| 5,207,275 | A | 5/1993 | Strattan et al. | |
| 5,211,243 | A | 5/1993 | Strattan et al. | |
| 5,246,236 | A | 9/1993 | Szarka et al. | |
| 5,285,853 | A | 2/1994 | Echkert et al. | |
| 5,456,314 | A * | 10/1995 | Boehm et al. | 166/208 |
| 5,769,162 | A | 6/1998 | Bartlett et al. | |
| 6,367,558 | B1 * | 4/2002 | Borak, Jr. | 166/387 |
| 6,378,613 | B1 | 4/2002 | Kent et al. | |
| 6,637,750 | B2 * | 10/2003 | Quoiani | 277/339 |
| 6,668,919 | B2 | 12/2003 | Radi | |
| 6,691,785 | B2 | 2/2004 | Patel | |
| 6,840,323 | B2 | 1/2005 | Fenton et al. | |
| 6,978,839 | B2 | 12/2005 | Fenton et al. | |
| 7,025,133 | B2 | 4/2006 | McIntosh | |
| 7,219,741 | B2 | 5/2007 | Fenton et al. | |

OTHER PUBLICATIONS

Search Report and Written Opinion from PCT/US2009/054337.
U.S. Patent and Trademark Office, Office Action dated Sep. 27, 2011, U.S. Appl. No. 12/544,011, filed Aug. 19, 2009.

* cited by examiner

*Primary Examiner* — David Andrews
*Assistant Examiner* — Richard Alker
(74) *Attorney, Agent, or Firm* — Parsons Behle & Latimer

(57) ABSTRACT

A wellhead assembly including a wellhead housing. The wellhead housing comprises a throughbore having a recessed sealing area and a tubing hanger positioned in the throughbore. A seal is positioned between the wellhead housing and the tubing hanger, the seal being positioned so as to form a gap between the seal and the wellhead housing. The wellhead assembly can further include a seal energizer capable of moving relative to the seal in a manner that forces the seal against the wellhead housing to bridge the gap. A method of installing a tubing hanger into a throughbore of a wellhead housing is also disclosed.

14 Claims, 7 Drawing Sheets

TUBING HANGER SEAL

The present disclosure claims benefit of U.S. Provisional Patent Application No. 61/090,462, filed Aug. 20, 2008, and U.S. Provisional Patent Application No. 61/090,000, filed Aug. 19, 2008, both of which applications are hereby incorporated by reference in their entirety.

BACKGROUND

The present disclosure relates generally to a tubing hanger for use with a subsea wellhead, and in particular, a mechanism for sealing a tubing hanger in a subsea wellhead.

Tubing hangers are employed in subsea wellheads used in, for example, oil and gas wells. The tubing hanger supports the tubing, or "string", which extends down into the production zone of the well. The tubing hanger can be installed in the wellhead at the well location. Tubing hanger installation can be performed by various means, such as, for example, by employing a tubing hanger running tool that positions the tubing hanger into the wellhead. Tubing hangers are generally locked into place in the wellhead in order to reduce undesired movement of the tubing hanger relative to the wellhead.

The annulus between the tubing hanger and the wellhead housing employs a seal barrier. One of the seals that forms such a barrier is a metal seal that often functions by forming a forced contact with the sealing surface on the tubing hanger and wellhead housing.

When a tubing hanger is installed into or removed from a wellhead, seals formed between the tubing hanger and wellhead can sometimes be damaged. For example, during installation of the tubing hanger into the wellhead, seals that form part of the tubing hanger can contact portions of the wellhead through which they pass. The interference of the seal with the wellhead during installation can damage the seal.

Additionally, some tubing hanger designs may rely on the landing and/or locking movement of the tubing hanger relative to the wellhead in order to energize the seals. Such tubing hanger designs can make it difficult for operators to reposition the tubing hanger in the wellhead and/or verify that the tubing hanger is correctly positioned in the wellhead without risk of damaging the seals.

The present disclosure is directed to overcoming, or at least reducing the effects of, one or more of the issues set forth above.

SUMMARY

An embodiment of the present disclosure is directed to a wellhead assembly. The wellhead assembly comprises a wellhead housing comprising a throughbore having a recessed sealing area and a tubing hanger positioned in the throughbore. A seal is positioned between the wellhead housing and the tubing hanger, the seal being positioned so as to form a gap between the seal and the wellhead housing. The wellhead assembly can further include a seal energizer capable of moving relative to the seal in a manner that forces the seal against the wellhead housing to bridge the gap.

Another embodiment of the present disclosure is directed to a method of installing a tubing hanger into a throughbore of a wellhead housing, the tubing hanger having a seal and a seal energizer. The method comprises installing the tubing hanger in the throughbore with the seal in a de-energized position so that substantially no interference occurs between the wellhead housing and the seal during the installing. The tubing hanger is positioned so that the seal is proximate a recessed sealing area in the wellhead housing. The seal is then energized so that a portion of the seal is pushed into a sealing contact with the recessed sealing area.

Figure 1:
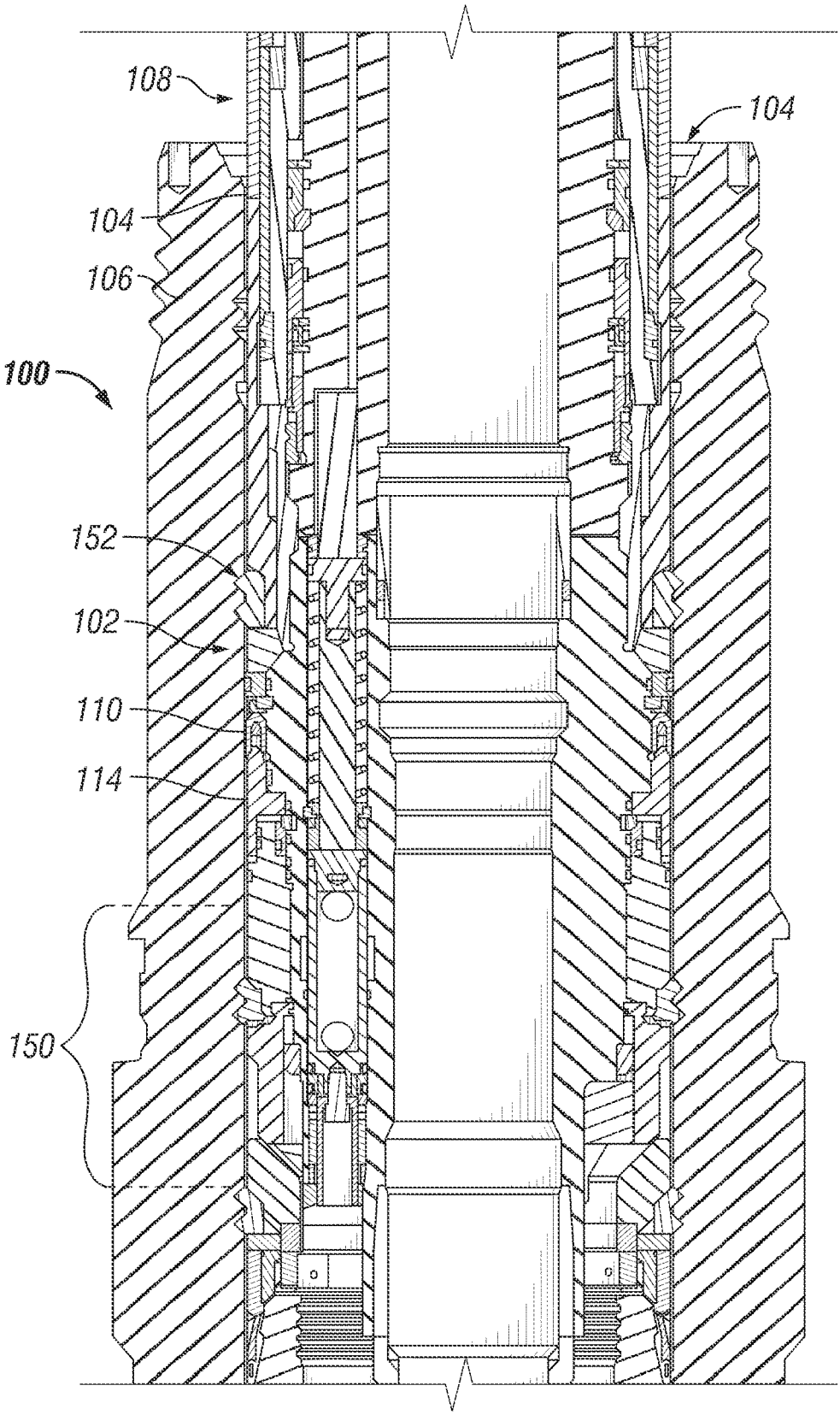
FIG. 1 illustrates a subsea wellhead assembly 100 that includes a tubing hanger 102 positioned in throughbore 104 of wellhead housing 106, according to an embodiment of the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

FIG. 1 illustrates a subsea wellhead assembly 100 that includes a tubing hanger 102 positioned in throughbore 104 of wellhead housing 106, according to an embodiment of the present disclosure. A tubing hanger running tool 108 engaging the tubing hanger 102 is also shown. As is well known in the art, the tubing hanger running tool 108 can be used to lower the tubing hanger 102 into position in the wellhead housing 106.

Tubing hanger 102 can include a seal 110, which can be positioned between the wellhead housing 106 and the tubing hanger 102. Seal 110 can be positioned so as not to physically contact the wellhead housing 106 while entering the bore. As more clearly shown in FIG. 7, this results in a gap 112 between the wellhead housing 106 and the seal 110.

Tubing hanger 102 can also include a seal energizer 114. As will be discussed in greater detail below, seal energizer 114 is capable of moving relative to the seal 110 in a manner that forces the seal 110 against the wellhead housing 106 to bridge the gap 112 and provide the desired sealing contact.

Figure 6:
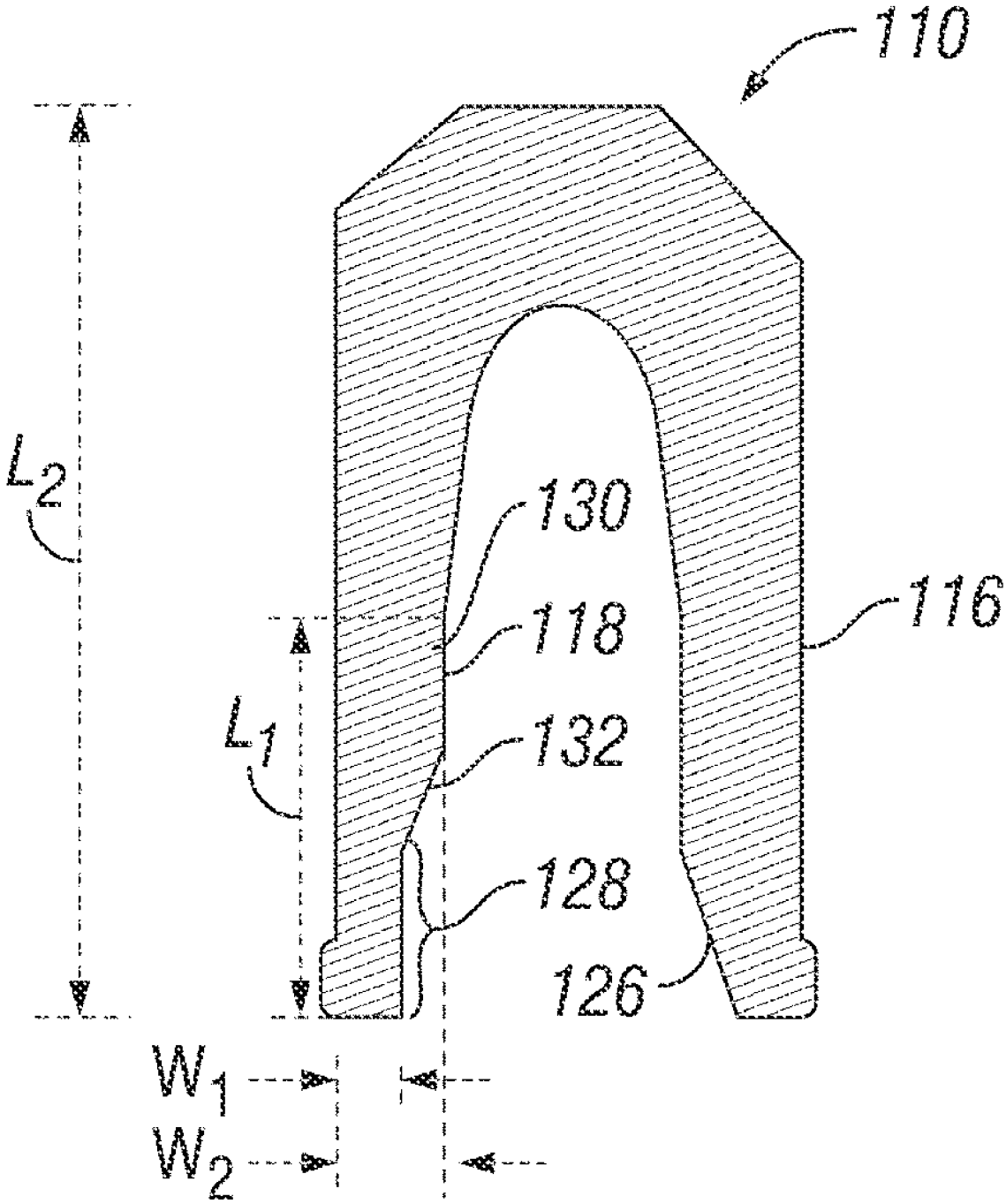
FIG. 6 illustrates a seal, according to an embodiment of the present disclosure.
Figure 7:
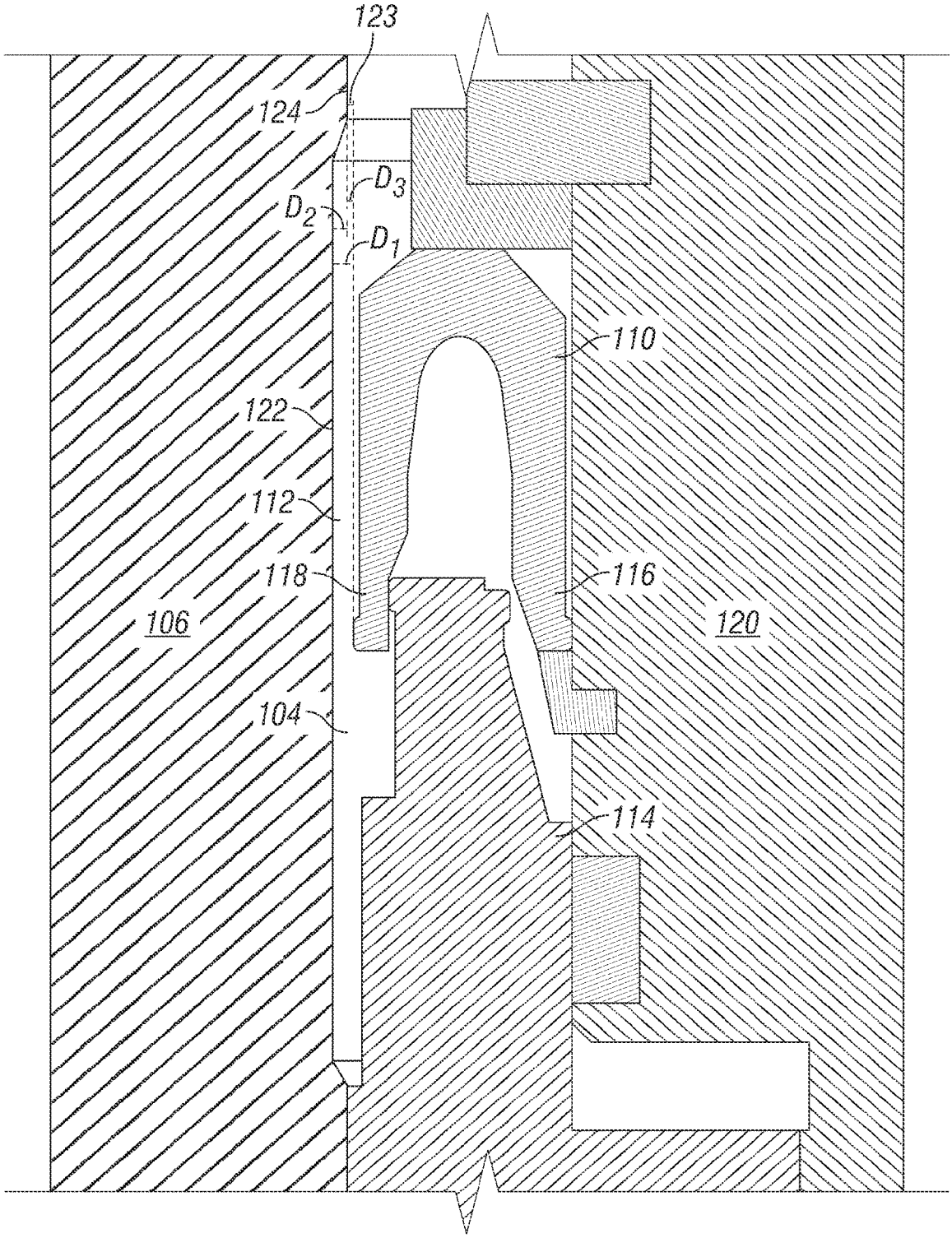
FIG. 7 illustrates a close up view of the seal in the subsea wellhead assembly of FIG. 2, according to an embodiment of the present disclosure.

The seal 110 can be an annular seal capable of sealing an annulus formed in throughbore 104 between a perimeter of the tubing hanger 102 and the wellhead housing 106. As shown in the embodiment of FIG. 6, the seal 110 can include a first leg 116 and a second leg 118. The first leg 116 can contact a tubing hanger body 120 of the tubing hanger 102, as illustrated in FIG. 7. The second leg 118 can be positioned proximal to the wellhead housing 106, so that a gap 112 can be formed between the wellhead housing 106 and the second leg 118.

Referring to FIG. 7, the throughbore 104 of wellhead housing 106 can include a recessed sealing area 122. Seal 110 can be positioned so that the second leg 118 is pushed into a sealing contact with the recessed sealing area 122 when the seal 110 is energized. Providing a recessed sealing area 122 helps to protect a surface of the sealing area 122 from damage that can occur during operations prior to the installation of the tubing hanger 102.

Recessed sealing area 122 can have any suitable dimensions that allow the desired sealing to occur. In one embodiment, the recess has a depth, $D_2$, ranging from about 0.01 inch to about 0.3 inch.

The width, $_{D1}$, of the gap 112 can be equal to the depth, $_{D2}$, of the recessed sealing area 122 plus the width, $_{D3}$, where $_{D3}$ is the width of a clearance gap 123 between seal 110 and the major wall surface 124 of the throughbore 104 that surrounds the recessed sealing area 122. Clearance gap 123 can be wide enough to allow seal 110 to pass through throughbore 104 during installation without substantial interference with the wellhead housing 106.

Seal 110 can be made of any suitable material capable of providing a sufficient seal between the tubing hanger 102 and the wellhead housing 106. The material for seal 110 can be chosen to meet any desired specifications or design criteria. For example, the material can be chosen to provide a desired deformation of the seal, to have desired stress and strain characteristics, durability, and/or the ability to withstand pressure loads without losing sealing capability. In an embodiment, the seal is a metal seal. In other embodiments, the seal comprises a non-metal material, such as a polymer.

Seal 110 can be designed to have any suitable shape that will function to provide the desired seal. FIG. 6 illustrates a cross-sectional view of a U-shaped annulur seal design, according to an embodiment of the present application. In an embodiment, first leg 116 can include a tapered portion 126 that can help facilitate the proper engagement of seal energizer 114 (shown in FIG. 7) with seal 110. In other embodiments, first leg 116 may not be tapered, or may have some other suitable design that facilitates engagement with seal energizer 114.

Figure 5:
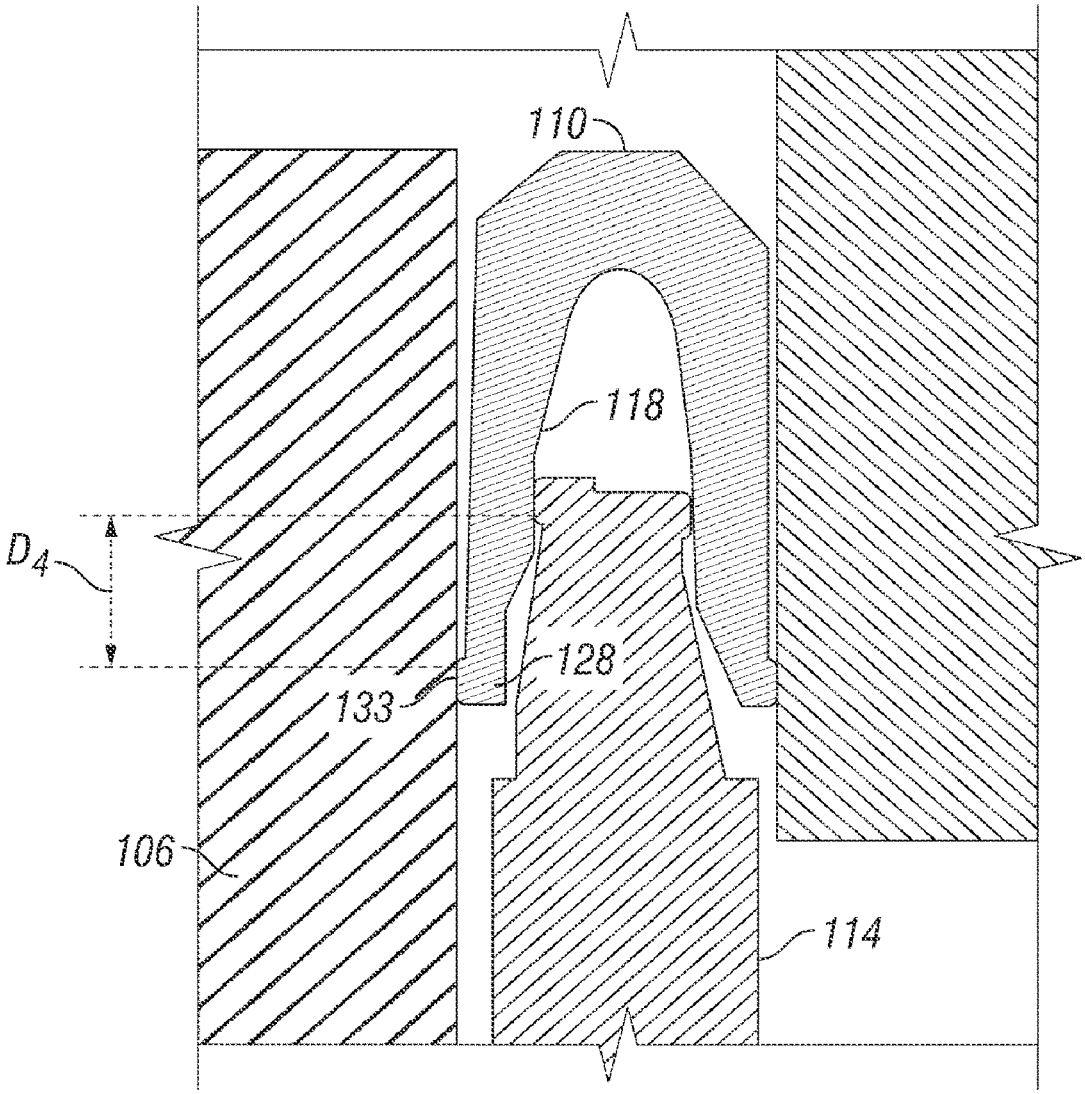
FIG. 5 illustrates an energized seal, according to an embodiment of the present disclosure.

Second leg 118 of seal 110 comprises a distal portion 128 having a first width, $w_1$; a proximal portion 130 having a second width, $w_2$; and a tapered portion 132 between the proximal portion 130 and distal portion 128, where $w_1$ is less than $w_2$. As shown in FIG. 5, this configuration allows the seal energizer 114 to support the second leg 118 at the proximal portion 130, which is above the interface 133 where the second leg 118 contacts the wellhead housing 106 when the seal is energized. The distance, $D_4$, from a point where the seal energizer 114 supports seal 110 to the nearest point at which the seal 110 contacts wellhead housing 106 can be any suitable distance, such as, for example, a distance in a range of about 0.1 inch to above 1 inch, depending on the seal size and choice of material. This configuration can allow for increased elasticity of the seal 110 at the seal—wellhead housing interface 133, relative to the elasticity that would be achieved if the seal energizer 114 supported the second leg 118 at the portion of the second leg 118 directly behind the sealing contact point.

The dimensions of seal 110 can be any suitable dimensions that are sufficient to provide the desired sealing contact. Referring to FIG. 6, the elasticity of seal 110 at the seal-wellhead housing interface 133 (shown in FIG. 5) can depend in part on the length chosen for $L_1$. For example, the ratio of $L_1$ to $L_2$, where $L_2$ is the overall length of the seal 110, can range from about 1:20 to about 9:10, such as from about 4:5 to about 3:5. Example ratios of $W_2$ to $L_2$ can range from about 1:100 to 1:2, such as about 1:10 to about 1:5. The overall length $L_2$ of the seal 110 may be shorter than the overall length of the recessed sealing area 122, as shown in FIG. 7.

Figure 2:
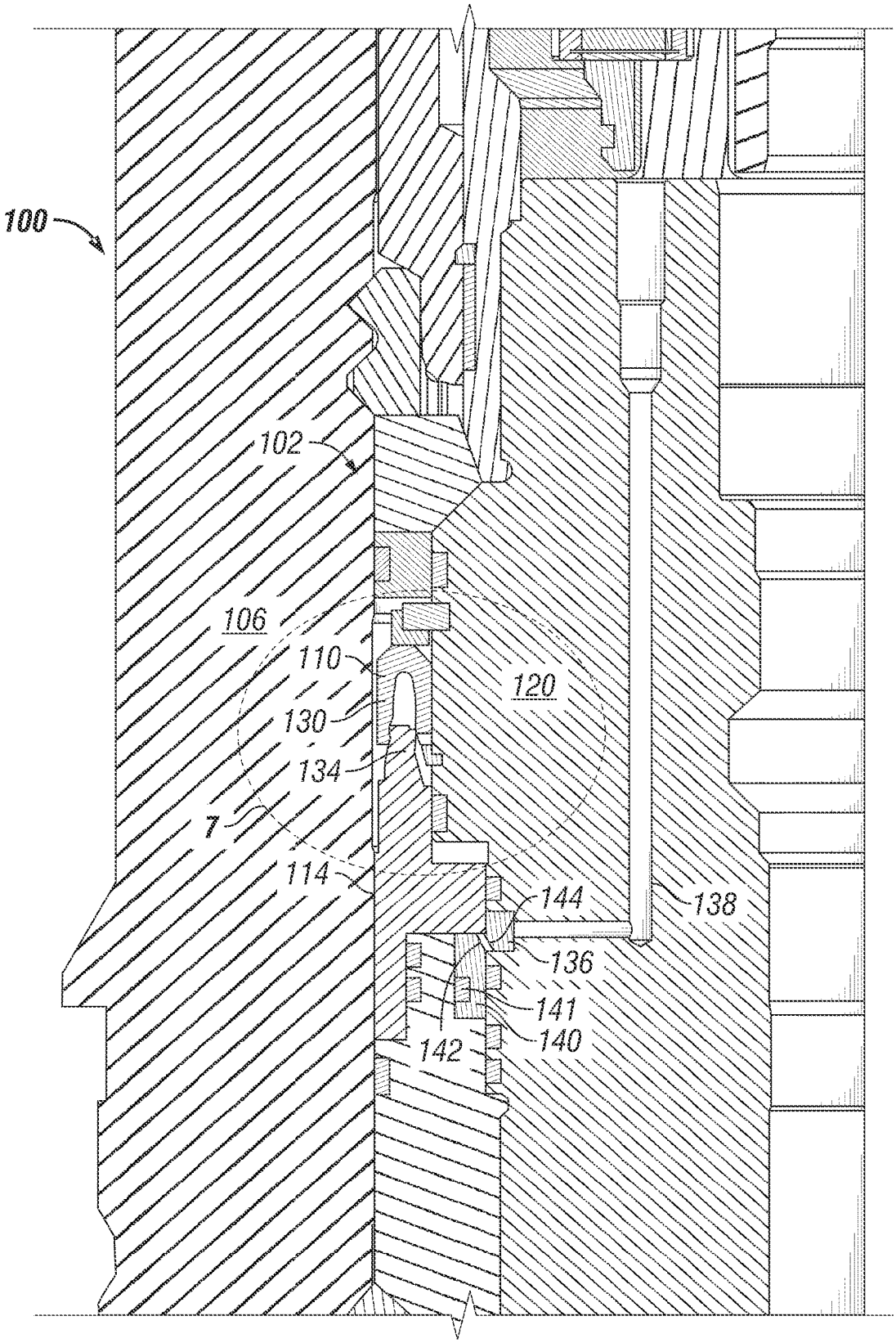
FIGS. 2 to 4 illustrate a seal energizing and de-energizing system of the subsea wellhead assembly of FIG. 1, according to an embodiment of the present disclosure.

A description of the seal energizing and de-energizing systems will now be described with reference to FIGS. 2 to 4. As discussed above, the tubing hanger 102 of the present application can include a seal energizer 114 for engaging a portion of seal 110 into a sealing contact with the wellhead housing 106 to seal the subsea wellhead assembly 100. In an embodiment, seal energizer 114 can be an annular ring positioned around the tubing hanger body 120. Seal energizer 114 can include an energizer tip 134 that is shaped to engage and force a desired deformation of seal 110. For example, energizer tip 134 can have a shape that allows it to contact the proximal portion 130 of second leg 118 of seal 110 to force the distal portion 128 into sealing contact with wellhead housing 106 without seal energizer 114 being in contact with the distal portion 128, as illustrated in FIG. 5.

Seal energizer 114 can be configured to move relative to the seal 110 in any suitable manner. For example, seal energizer 114 can be configured to slide back and forth in an axial direction on the tubing hanger body 120. The force employed to move seal energizer 114 can be applied by any suitable means using hydraulic, mechanical or electrical devices. FIG. 2 illustrates a cross sectional view of an embodiment in which a pressure port 138 can be used to hydraulically force seal energizer 114 to engage seal 110. FIGS. 3 and 4 illustrate a separate cross sectional view of the FIG. 2 embodiment, in which a pressure port 145 can be employed to unlock and hydraulically force the seal energizer 114 so as to disengage from the seal 110. The embodiments of FIGS. 2 to 4 will be discussed in greater detail below.

A locking mechanism 136 can be employed to hold the seal energizer in place in relation to the seal when the seal is energized. In an embodiment, the locking mechanism can be a C-ring, which can be biased to move under the seal energizer 114 when seal energizer 114 is positioned to engage seal 110, as illustrated in FIG. 3.

The operation of the seal energizer 114 can be independent from the operation of landing and locking the tubing hanger 102. For example, tubing hanger 102 can be positioned into throughbore 104 and locked into place prior to energizing the seal 110. Thus, the motion of positioning the tubing hanger in the wellhead housing during the landing and locking processes is not necessarily employed to energize the seal 110. Any suitable landing and locking mechanisms can be employed. An exemplary landing mechanism 150 and locking mechanism 152 is illustrated in FIG. 1 and can be employed to position and lock tubing hanger 102 in wellhead assembly 100, as described in detail in co-pending U.S. patent application Ser. No. 12/543,929, the disclosure of which is hereby incorporated by reference in its entirety.

In an embodiment, tubing hanger 102 can comprise a suitable mechanism for de-energizing the seal 110. De-energizing seal 110 can involve disengaging energizer tip 134 of seal energizer 114 from seal 110. As mentioned above, a suitable de-energizing mechanism 140 is illustrated in FIGS. 3 to 4. By employing both the seal energizer 114 and the de-energizing mechanism 140, the seal 110 can be repeatedly energized to bridge the gap 112 and repeatedly de-energized to form the gap 112.

In an embodiment, the de-energizing mechanism 140 can be configured to unlock the locking mechanism 136. For example, de-energizing mechanism 140 can include a tapered portion 142 (FIG. 2) that can engage a tapered portion 144 of locking mechanism 136. In an embodiment, the de-energizing mechanism 140 can comprise a seal 141.

Figure 3:
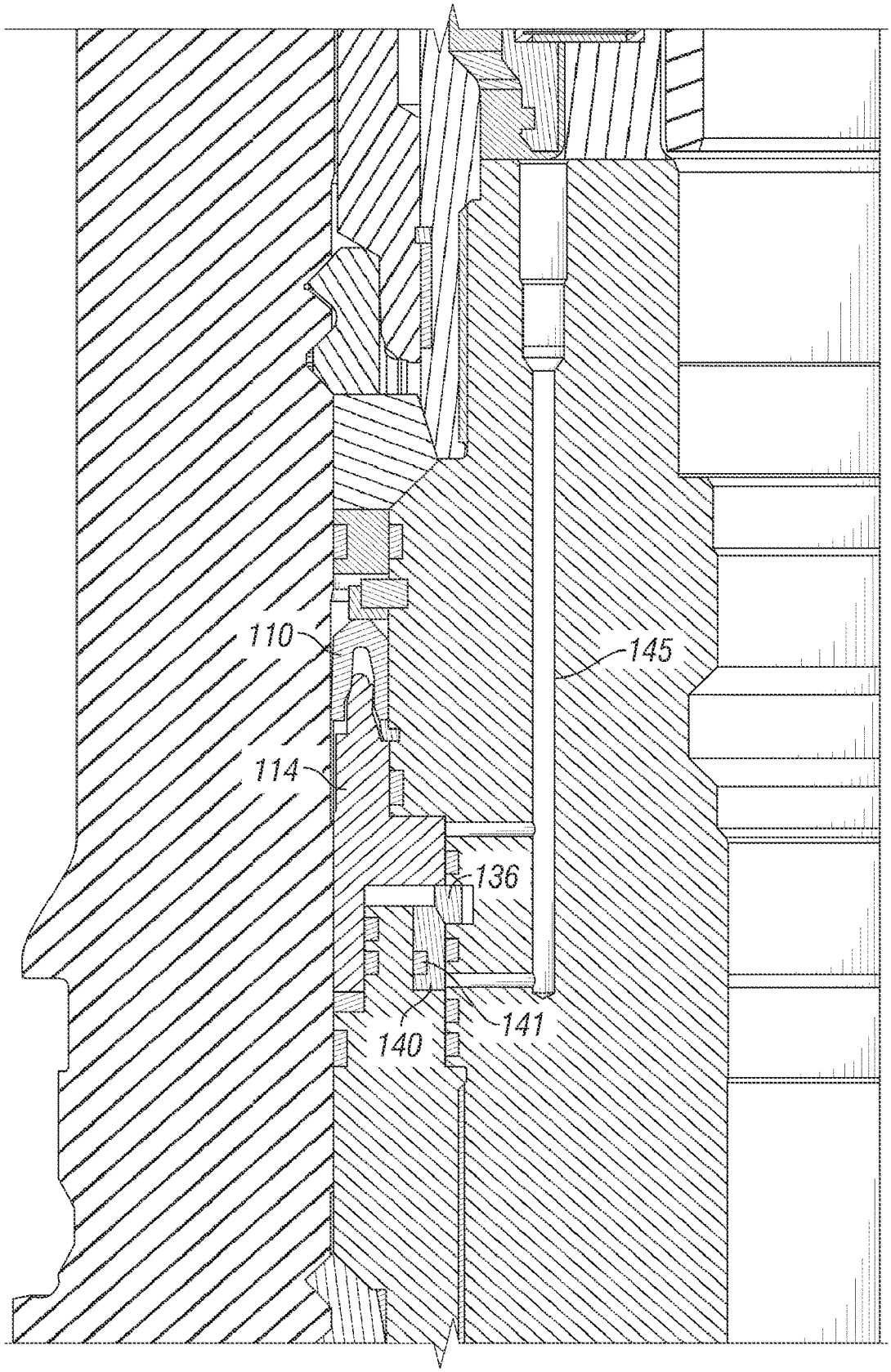
Figure 4:
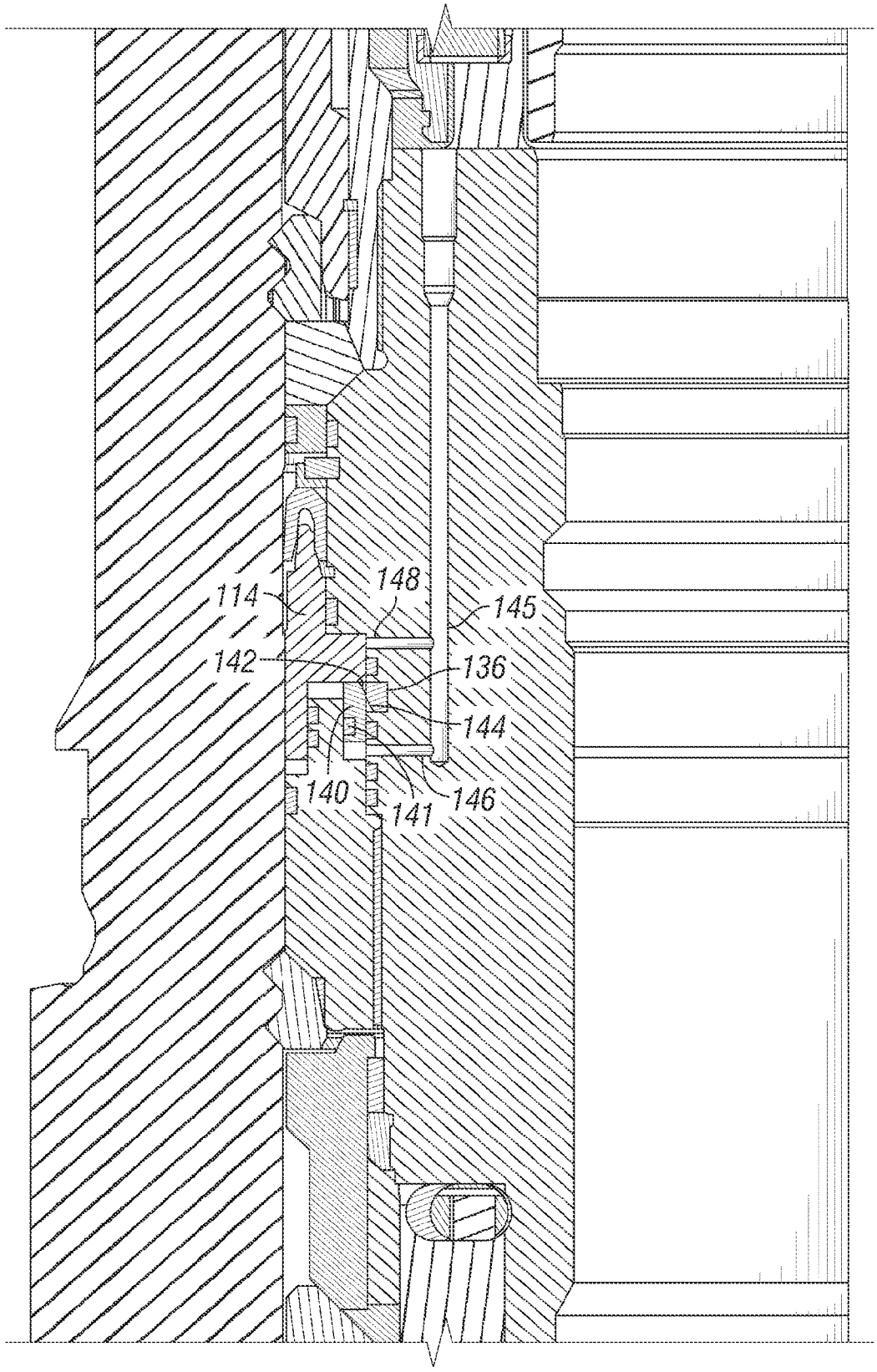

FIG. 3 shows de-energizing mechanism 140 and locking mechanism 136 in a locked position. As illustrated in FIG. 4, the de-energized mechanism 140 can be forced against the locking mechanism 136, which in turn forces the locking mechanism 136 into an unlocked position in which locking mechanism 136 no longer supports the seal energizer 114. This allows seal energizer 114 to disengage from, and thereby de-energize, seal 110.

In an embodiment, the de-energizing mechanism 140 can de-energize seal 110 using pressure from a single pressure port 145. As illustrated in FIG. 4, pressure port 145 can supply pressure through branch pressure ducts 146 and 148 to simultaneously apply force to both the de-energizing mechanism 140 and the seal energizer 114. The pressure applied is sufficient to cause the de-energizing mechanism 140 to force the locking mechanism 136 from a locked position to an unlocked position, so that locking mechanism 136 no longer acts to retain the seal energizer 114 in position, as illustrated in FIG. 4. Once the locking mechanism 136 is in the unlocked position, seal energizer 114 is forced downward to disengage from seal 110 by the pressure applied through duct 148, even though pressure applied through duct 146 continues to push the de-energizing mechanism up against the seal energizer 114. This is because the surface area of seal energizer 114 that is exposed to pressure from duct 148 is larger than the surface area of the de-energizing mechanism 140 that is exposed to pressure from duct 146, so that the downward force applied to the seal energizer 114 is greater than the upward force applied to the de-energizing mechanism 140. In other embodiments, multiple pressure ports can be employed to de-energize seal 110.

A method of installing the tubing hanger of the present application into a wellhead will now be described. The tubing hanger can include a seal 110 and a seal energizer 114, similarly as described herein. The tubing hanger 102 can be installed in a throughbore 104 of a wellhead housing 106. During installation, the seal can be in a de-energized position, similar to the seal 110 illustrated in FIG. 2. While in a de-energized position, the second leg 118 of seal 110 is positioned to be proximate to, but not in contact with, the wellhead housing 106. This results in a clearance gap 123, as discussed above with reference to FIG. 7, between the wellhead housing 106 and the second leg 118, as the seal is lowered a distance into the throughbore. Due to the clearance gap 123, substantially no interference occurs between the wellhead housing 106 and the seal 110 while positioning the tubing hanger 102 in throughbore 104.

The tubing hanger 102 can be positioned so that the seal 110 is proximate the recessed seal area 122 in the wellhead housing 106. The seal 110 can then be energized so that a portion of the seal 110, such as second leg 118, is pushed into a sealing contact with the recessed sealing area 122.

The process of energizing seal 110 can be accomplished using any suitable technique that results in the desired sealing contact between the seal 110 and wellhead housing 106. In an embodiment, energizing the seal 110 comprises actuating seal energizer 114, as disclosed above. Other exemplary techniques for energizing seals are well known in the art and can be employed in place of or in addition to actuating seal energizer 114.

As discussed above, seal energizer 114 can be designed to push against the second leg 118 of the seal 110 at a point above the seal-wellhead housing interface 133 where the second leg 118 contacts the wellhead housing 106. This can allow for increased elasticity of the seal 110 at the interface 133, relative to the elasticity that would be achieved if the seal energizer 114 pushed against the seal 110 at the portion of the second leg 118 that interfaced with the wellhead housing 106 when seal 110 is energized.

FIG. 5 illustrates seal 110 when it is energized by seal energizer 114. When the seal 110 is energized, stresses occur within the seal. The deformation of seal 110 that occurs as a result of these stresses can be sufficiently elastic to allow the desired sealing contact with the wellhead housing 106 to be maintained under pressure and temperature loading cycles during the life of service inside the wellhead.

In an embodiment, the method of the present application can further comprise positioning a locking mechanism 136 to constrain the seal energizer 114 in place in relation to the seal 110 while the seal is energized. Suitable locking mechanism designs other than the design illustrated in FIGS. 1-4 can be employed. Choosing alternative suitable locking mechanisms designs would be within the ordinary skill of the art.

In an embodiment, the method of the present application can further comprise de-energizing the seal by forcing the locking mechanism 136 from its locked position so that it no longer supports the seal energizer 114. The seal energizer 114 can then be forced to a position so that it no longer energizes the seal. In an embodiment, forcing the locking mechanism 136 and forcing the seal energizer 114 can both be accomplished using pressure from a single pressure port. In other embodiments, pressure from different pressure ports can be used, as can any other suitable means for applying the force to drive the locking mechanism 136 and the de-energizing of seal energizer 114.

Although various embodiments have been shown and described, the present disclosure is not so limited and will be understood to include all such modifications and variations as would be apparent to one skilled in the art.

What is claimed is:

1. A wellhead assembly comprising:

a wellhead housing comprising a throughbore having a recessed sealing area, the recessed sealing area comprising a single recess;

a tubing hanger positioned in the throughbore;

a seal positioned between the wellhead housing and the tubing hanger, the seal being positioned so as to form a gap between the seal and the wellhead housing, wherein the seal is an annular seal capable of sealing an annulus formed in the throughbore between a perimeter of the tubing hanger and the wellhead housing, wherein a length of the seal is shorter than a length of the single recess and wherein the seal comprises a first leg and a second leg, the first leg contacting the perimeter of the tubing hanger and the second leg being proximal to the wellhead housing, the gap being formed between the wellhead housing and the second leg; and a seal energizer capable of moving relative to the seal in a manner that forces the seal against the wellhead housing to bridge the gap.

2. The wellhead assembly of claim 1, wherein the recessed sealing area is positioned so that the second leg is capable of being moved into a sealing contact with the recessed sealing area when the seal is energized.

3. The wellhead assembly of claim 2, wherein the recessed sealing area has a depth ranging from about 0.1 inch to about 0.3 inch.

4. The wellhead assembly of claim 2, wherein the seal and the seal energizer are configured so that when the seal is energized, the seal energizer contacts the second leg of the seal at a point above an interface where the seal contacts the wellhead housing.

5. The wellhead assembly of claim 4, wherein the second leg of the seal comprises a distal portion having a first width, a proximal portion having a second width and a tapered portion between the distal portion and proximal portion, the first width being less than the second width.

6. The wellhead assembly of claim 5, wherein the seal and seal energizer are configured so that when the seal is energized, the seal energizer contacts the proximal portion of the second leg without substantially contacting the distal portion, and the distal portion contacts the wellhead housing.

7. The wellhead assembly of claim 1, wherein the second leg of the seal comprises a distal portion having a first width, a proximal portion having a second width and a tapered portion between the distal portion and proximal portion, the first width being less than the second width.

8. The wellhead assembly of claim 7, wherein the seal and seal energizer are configured so that when the seal is energized, the seal energizer contacts the proximal portion of the second leg without substantially contacting the distal portion, and the distal portion contacts the wellhead housing.

9. The wellhead assembly of claim 1, wherein the seal is a metal seal.

10. A wellhead assembly comprising:

a wellhead housing comprising a throughbore having a recessed sealing area, the recessed sealing area comprising a single recess;

a tubing hanger positioned in the throughbore;

a seal positioned between the wellhead housing and the tubing hanger, the seal being positioned so as to form a gap between the seal and the wellhead housing; and a seal energizer capable of moving relative to the seal in a manner that forces the seal against the wellhead housing to bridge the gap, wherein the seal comprises a first leg and a second leg, the first leg contacting the perimeter of the tubing hanger and the second leg being proximal to the wellhead housing when the seal is not energized, the gap being formed between the wellhead housing and the second leg, wherein the recessed sealing area is positioned so that the second leg is capable of being moved into a sealing contact with the recessed sealing area when the seal is energized, and further wherein a width of the gap is greater than the depth of the recessed sealing area.

11. A wellhead assembly comprising:

a wellhead housing comprising a throughbore having a recessed sealing area, the recessed sealing area comprising a single recess;

a tubing hanger positioned in the throughbore;

a seal positioned between the wellhead housing and the tubing hanger, the seal being positioned so as to form a gap between the seal and the wellhead housing, wherein the seal is an annular seal capable of sealing an annulus formed in the throughbore between a perimeter of the tubing hanger and the wellhead housing, wherein a length of the seal is shorter than a length of the single recess;

a seal energizer capable of moving relative to the seal in a manner that forces the seal against the wellhead housing to bridge the gap; and wherein the tubing hanger comprises a mechanism for de-energizing the seal, the seal energizer and the de-energizing mechanism allowing the seal to be repeatedly energized to bridge the gap and repeatedly de-energized to form the gap.

12. The wellhead assembly of claim 11, further comprising a locking mechanism for holding the seal energizer in place in relation to the seal while the seal is energized, the locking mechanism being positioned so as to constrain the seal energizer which in turn maintains the seal energization.

13. The wellhead assembly of claim 12, wherein the de-energizing mechanism is configured to unlock the locking mechanism and de-energize the seal using pressure from a single pressure port.

14. A wellhead assembly comprising:

a wellhead housing comprising a throughbore having a recessed sealing area, the recessed sealing area comprising a single recess;

a tubing hanger positioned in the throughbore;

a seal positioned between the wellhead housing and the tubing hanger, the seal being positioned so as to form a gap between the seal and the wellhead housing, wherein the seal is an annular seal capable of sealing an annulus formed in the throughbore between a perimeter of the tubing hanger and the wellhead housing, wherein a length of the seal is shorter than a length of the single recess;

a seal energizer capable of moving relative to the seal in a manner that forces the seal against the wellhead housing to bridge the gap; and at least one of a landing mechanism and a locking mechanism, wherein the operation of the seal energizer is independent from the operation of the landing and/or locking mechanism(s).

* * * * *